US005313031A

United States Patent [19]

Takahashi et al.

[11] Patent Number: 5,313,031

[45] Date of Patent: May 17, 1994

[54] ELECTRIC SWITCH GEAR WITH IMPROVED STATIONARY CONTACT CONFIGURATION

[75] Inventors: Mitsugu Takahashi; Takao Mitsuhashi; Kenichi Nishina, all of Amagasaki, Japan

[73] Assignee: Mitsubishi Denki Kabushiki Kaisha, Tokyo, Japan

[21] Appl. No.: 809,325

[22] Filed: Dec. 18, 1991

[30] Foreign Application Priority Data

| | | | |
|---|---|---|---|
| Dec. 28, 1990 | [JP] | Japan | 2-409110 |
| Dec. 28, 1990 | [JP] | Japan | 2-409111 |
| Dec. 28, 1990 | [JP] | Japan | 2-409112 |
| Sep. 13, 1991 | [JP] | Japan | 3-234773 |

[51] Int. Cl.[5] ..... H01H 1/06

[52] U.S. Cl. ..... 200/275; 200/144 R; 200/400; 200/147 R

[58] Field of Search ..... 200/275, 239, 248, 271, 200/400, 401, 144 R, 147 R; 335/16, 147, 195, 201

[56] References Cited

U.S. PATENT DOCUMENTS

| | | | |
|---|---|---|---|
| 1,958,159 | 5/1934 | Bresson | 335/195 |
| 2,944,129 | 7/1960 | Cole et al. | 335/16 |
| 4,491,705 | 1/1985 | Hayashi et al. | 200/144 R |
| 4,642,428 | 2/1987 | Yoshiyasu et al. | 200/144 R |
| 4,689,588 | 8/1987 | Murata et al. | 335/201 |
| 4,835,501 | 5/1989 | Hovanic | 335/16 |
| 5,142,111 | 8/1992 | Blanchard et al. | 200/147 R |

FOREIGN PATENT DOCUMENTS

| | | |
|---|---|---|
| 0231600 | 8/1987 | European Pat. Off. . |
| 0419324 | 3/1991 | European Pat. Off. . |
| 7307293 | 5/1973 | Fed. Rep. of Germany . |
| 2422242 | 11/1979 | France . |
| 60-49533 | 3/1985 | Japan . |
| 2-68831 | 3/1990 | Japan . |
| 1089971 | 11/1967 | United Kingdom . |
| 2023344 | 12/1979 | United Kingdom . |

*Primary Examiner*—Henry J. Recla
*Assistant Examiner*—David J. Walczak
*Attorney, Agent, or Firm*—Burns, Doane, Swecker & Mathis

[57] ABSTRACT

A switch is configured that: in the closed-circuit state, at least part of its movable contact arm enters into a oblong generally hexahedral space defined by its elongated stationary conductor in its closed circuit position. Both contacting and breaking of the moving contact and the fixed contact occur in the space. Overall electromagnetic forces generated by the current flowing through the stationary conductor, movable contact arm and the arc induced at the time of breaking effectively act to extend the arc toward a terminal section of the stationary conductor and to increase the arc resistance at the time just after the breaking of both the contacts.

8 Claims, 14 Drawing Sheets

ELECTRIC SWITCH GEAR WITH IMPROVED STATIONARY CONTACT CONFIGURATION

FIELD OF THE INVENTION AND RELATED ART STATEMENT

1. FIELD OF THE INVENTION

The present invention generally relates to an electrical switch, and, in particular, a switch which generates an electrical arc in a switch housing at the time of current breaking such as electric circuit breakers, fault current limiters, and electromagnetic contactors.

2. DESCRIPTION OF THE PRIOR ART

FIG. 21 is a schematic side view of an example of the conventional electfic circuit breaker in its break state including a switch element. In this figure, a movable contact arm 1 has a moving contact 2 fixed on its distal end, numeral 3 denotes a fixed contact fixed on the distal end (namely, moving end) of a stationary conductor 4, and numeral 5 denotes a terminal section which forms a proximal end (namely, journaled end) of the fixed conductor 4. The relative position of the movable contact arm 1 with respect to the stationary conductor 4 is such that the contacting face of said moving contact 2 can reach the contacting face of said fixed contact 3 by the clockwise rotation of said movable contact arm 1 around a fulcrum pin 14 (not shown in this figure). Numeral 6 represents arc-extinguishing plates (arc chute or deioners) supported by a side plate 7. Numeral 8 denotes a mechanical unit for rotating said movable contact arm 1. Numeral 9 designates a handle for manually actuating the mechanical unit 8. Numeral 10 represents another terminal section, and numeral 11 denotes a conductor connecting said movable contact arm 1 to said terminal section 10. Numeral 12 represents a housing for enclosing these components, and numeral 13 denotes an exhaust outlet provided on the housing 12.

The stationary conductor 4 has a lead-in part 4*a* and a base part 4*c*, rising part 4*d* and folded-back upper part 4*e*, thereby forming a laterally laid u-shape. The movable contact arm 1 is disposed only above or on the folded-back upper part 4*e* extending toward a direction opposite to the lead-in part 4*a* and the base part 4*c*.

In the following paragraphs, the operation of the above-mentioned circuit breaker will be described. The terminal section 5 is connected to a power source and the terminal section 10 is connected to a load. First, the handle 9 is manipulated in the direction indicated by arrow B. By manipulating as above-described, the mechanical unit 8 is actuated to rotate the movable contact arm 1 around a shaft, which is not shown in this figure but provided at its proximal end, in the clockwise direction of the drawing. The moving contact 2 reaches the fixed contact 3 to supply electric power from the power source to the load. In this state, the moving contact 2 is pressed against the fixed contact 3 with a predetermined pressure in order to ensure reliable electrical contact (current flowing).

In this steady electrified state, if a large short-circuiting or fault current flows in the circuit at the load side of the circuit breaker by a possible accident occurring in the load circuit, a current-detecting device (not shown) provided in the mechanical unit 8 actuates the mechanical unit 8 to rotate the movable contact arm 1 in the anti-clockwise direction. By this rotation, the moving contact 2 separates from the fixed contact 3 generating an electric arc between the contacts 2 and 3.

When a current of very high level, such as a short-circuit current or a fault current flows, the rotation of the movable contact arm separates both the contacts 2 and 3 usually in advance of the actuation of the mechanical unit 8, because a magnetic repulsion force between the contacting faces of the contacts 2 and 3 is strengthened by the current, surpassing the contacting pressure applied to the moving contact 2. The generated electric arc is drawn and extended by the arc extinguishing plates 6 thereby to be cooled. As a result, an electric arc resistance increases and an effective limiting of the fault current is performed to reduce the short-circuit current. Finally, the electric arc is extinguished at a zero point of the current and circuit breaking is completed.

The fault current limiting is very important for improving the reliable load circuit protecting function of the circuit breakers. In order to improve the fault current limiting characteristics, it is required to increase the above-mentioned electric arc resistance by extending the arc. One well-known and widely used method for extending the electric arc for increasing the arc resistance is disclosed in, for instance, Tokkai (Japanese Laid-Open Patent Publication) Sho 60-49,533 (49,533/85) or Tokkai Hei 2-68.831 (68,831/90), wherein the stationary conductor is also configured as indicated by FIG. 21. The shown stationary conductor 4 is composed of conductor parts 4*a* through 4*e*. A current is designed to flow along a path starting from a terminal section 5 through the conductor parts 4*a*, 4*b*, 4*c*, 4*d* and 4*e*, and ending at the fixed contact 3. An electromagnetic force induced by the current flowing through the conductor part 4*e* and applied to the electric arc becomes a force for extending the arc in the direction of arc extinguish plates 6. As a result, the arc resistance becomes higher and this configuration has proven to be effective for providing a circuit breaker with an excellent fault current limiting performance.

Further, since the current flowing through the conductor part 4*e* is substantially parallel with and in a direction opposite to the current flowing through the movable contact arm 1 in its closed position, an electromagnetic repulsive force acts on both the conductor part 4*e* and the movable contact arm 1, so as to increase the speed of the rotation of the movable contact arm 1 in the anti-clockwise direction. Thus, the distance between both the contacts 2 and 3 immediately after the breaking is increased rapidly, and the arc resistance is increased accordingly. Even when the voltage applied across the contacts 2 and 3 is at very high, dielectric breakdown of the circuit breaker is effectively avoided. As a result, the arc resistance becomes higher and a circuit breaker with excellent fault current limiting characteristics can be designed based on this concept.

In a usual alternating current breaking apparatus, the arc resistance should be increased for improving the fault current limiting performance as mentioned above. The increasing must however be performed immediately after the breaking of the contacts 2 and 3, and sufficiently before the opening current reaches its maximum value. An increase in the arc resistance only after the current reaches a large value is not sufficient for an effective current limiting, due to inertia effect of the current; but such an increase results in an increase of the electric arc energy produced in the circuit breaker because of its high level current and resistance. Accordingly possible damage to the circuit breaker becomes great. Therefore, an ideal configuration of the stationary conductor is capable of forcefully extending the electric arc induced just after the breaking of the contacts 2 and 3 by a strong electromagnetic force, but not exerting an electromagnetic force on such an arc of very high level current for a extending the arc.

The arc extinguishing operation of the conventional circuit breaker having a stationary conductor of the above-mentioned configuration is illustrated referring to schematic views shown in FIGS. 22 and 23. FIG. 22 shows a state just after the breaking of the contacts 2 and 3, whereas FIG. 23 shows a state wherein the movable contact arm 1 rotates to its open extreme. In those figures, numeral 14 designates the fulcrum pin of rotation provided on the movable contact arm 1, and the arc extinguishing plates 6 as well as the side plate 7 for supporting the arc extinguishing plates are omitted for clarity of illustration. Solid arrows indicate the directions of the current.

An electromagnetic force for extending the electric arc immediately after the breaking of the contacts 2 and 3 in the direction toward the terminal section 5 can only be generated by the current flowing through the path bounded by the conductor part 4*e*. Conversely, the currents flowing through all of the other conductor parts 4*a*, 4*b*, 4*c* and 4*d* can generate an electromagnetic force for extending the electric arc in the opposite direction, i.e., a direction away from the terminal section 5.

The paths of the current along the conductor parts 4*a* and 4*c* are disposed at a lower levels than that of the fixed contact 3. Further, since the current flowing through the conductor part 4*b* is in a direction opposite to the current of the arc these two currents repel each other. On the other hand, since the current flowing through the conductor part 4*d* is in the same direction as that of the arc, they attract each other. Thus, they result in an extension of the arc in a direction opposite to that toward the terminal section 5.

For that reason, the electromagnetic force for extending the arc in the direction toward the terminal section 5, which is generated by the current flowing through the conductor part 4*e*, is reduced accordingly. As stated-above, the structure of the conventional stationary conductor 4 shown in FIGS. 22 and 23 has a drawback in that it is not suited for effectively utilizing the electromagnetic forces induced by the currents flowing through the respective conductor parts thereof for extending the arc in the intended direction.

Further, the electromagnetic force for increasing the speed of the rotation of the movable contact arm 1 is generated only by the currents flowing through the conductor parts 4*d* and 4*e*, while the currents flowing through all of the other conductor parts of the stationary conductor 4 generate an electromagnetic force for decreasing the speed of the rotation of the movable contact arm 1. Therefore, the conventional structure of the stationary conductor 4 has another disadvantage in that it does not utilize the electromagnetic force generated by the current flowing through the stationary conductor 4 to effectively act on the arc for extending it, nor utilize it to act on the movable contact arm 1 for increasing its speed of the rotation.

In the conventional case, the arc energy generated in the circuit breaker becomes unnecessarily large, since there is no action to reduce the electromagnetic force which results to extend the arc in case of a large current. Therefore, the damage to the circuit breaker is severe. That is, in the above-mentioned prior art, when a very high level large current flows, such as fault current or short-circuited current, the movable conductor 1 turns to its extreme angular position as shown in FIG. 23. Then, if an electromagnetic force is applied to the arc in the direction toward the terminal section, there occurs a possibility of danger that a hot gas H due to this high level current arc is expelled from the exhaust outlet 13 in a large quantity. This may cause a ground fault (short-circuit) or fire outside the circuit breaker. Since an electromagnetic force caused by the current flowing through the movable contact arm 1 is inherently a force which acts to extend the arc in the direction toward the terminal section 5, hazards may further be enhanced by the addition of the electromagnetic force in the same direction caused by the current flowing through the conductor part 4*e* to the first-mentioned electromagnetic force.

OBJECTS AND SUMMARY OF THE INVENTION

The present invention has been made for overcoming the above-stated drawbacks and disadvantages of the conventional switches, and has, as its objects, to provide a switch having excellent fault current limiting characteristics which limits damage due to the electric arc energy as well as the hot gas caused by the arc outside the housing.

According to the present invention, there is provided a switch comprising a housing, a movable contact arm composed of an elongated conductor having a moving contact on its distal end and a fulcrum pin as an axis of rotation on its proximal end which is pivotally supported by said housing. Also included is a stationary conductor composed of an elongated conductor shaped to define a oblong generally hexahedral space in said housing, and having a fixed contact on its distal end and a terminal section on its proximal end. The switch is characterized in that;

the oblong generally hexahedral space has a three-dimensional shape defined substantially by a bent elongated conductor, and the fixed contact faces inward in the oblong generally hexahedral space defined by said stationary conductor.

In addition, the stationary conductor is shaped to permit the rotation of the movable contact arm for entering into the oblong generally hexahedral space, and the stationary conductor has a configuration in which at least part of the movable contact arm including the moving contact enters into the oblong generally hexahedral space in at least the closed circuit position of both the contacts.

In the above-stated switch, the stationary conductor may preferably comprise a first conductor part including the terminal section, a second conductor part including the fixed contact and a third conductor part connecting the first conductor part with the second conductor part, and may be configured to take a generally J-shape with these members.

Said third conductor part may preferably be placed between said fixed contact and said axis of rotation of said movable contact arm.

Alternatively, said axis of rotation of said movable contact arm may preferably be placed between said third conductor part and said fixed contact.

Said first conductor part may preferably be placed between the contacting face of the moving contact and the contacting face of the fixed contact in a contact open position, while the contacting face of the moving contact may preferably be placed between the contacting face of the fixed contact and said first conductor part in a closed circuit position.

In a switch such as described above, a plane, which is defined by the first conductor part and in parallel with a plane including the contacting surface of the fixed contact, may preferably be placed between a plane including the axis of rotation and in parallel with the plane including the contacting face of the fixed contact, and the plane including the contacting face of the fixed contact.

Alternatively, a plane including the axis of rotation and in parallel with a plane including the contacting face of the fixed contact may preferably be placed between a plane defined by the first conductor part in parallel with the plane including the contacting face of the fixed contact, and the plane including the contacting face of the fixed contact.

The plane including said axis of rotation and in parallel with a plane including the contacting face of the fixed contact may alternatively intersect the plane defined by any edge of the first conductor part, in a manner that at least part of the movable contact arm may still be in said oblong generally hexahedral space even in a open circuit position of both the contacts.

In the above-stated switch, both the first and third conductor parts may preferably have lengthwise slots connected continuously beyond the conductor parts' common boundary to permit unobstructed passage of the movable contact arm therethrough at the time of the arm's rotation.

Alternatively, both the first and third conductor parts may preferably have lengthwise recesses connected continuously beyond the conductor parts' common boundary to permit unobstructed lateral passage of the movable contact arm at the time of the arm's rotation. The recesses may preferably be formed by structuring the first and the third conductor parts into an integral and vertical plate whose side is open for lateral passage. As above-mentioned, all of the currents, which flow through the current path formed by the stationary conductor of the switch built in accordance with the present invention, can effectively contribute to the generation of an electromagnetic force for extending the arc immediately after the breaking of the contacts toward the terminal section. Further, the current path functions to reduce the electromagnetic force for extending the arc toward the terminal section at the time when the movable contact arm rotates to its open extreme.

Thus, the present invention has an advantage in that it can provide a switch having an excellent current limiting performance and which reduces damage attributable to the arc energy as well as exhaustion of the hot gas.

Further, since the second conductor part has a part which extends in parallel with the movable contact arm in its closed circuit state, the switch has another advantage of rapid rise-up of the arc resistance for better current limiting performance.

When the switch including the axis of rotation and in parallel with the plane including the contacting face of the fixed contact is placed between the plane defined by the first conductor part and the plane including the contacting face of the fixed contact, the electromagnetic forces generated by the current flowing through the first conductor part and the movable contact arm can effectively increase the torque for increasing the rotational speed of the movable contact arm immediately after the breaking of both the contacts.

Further, in the switch wherein the plane including the axis of rotation and in parallel with a plane including the contacting face of the fixed contact intersects the plane defined by the first conductor part, the electromagnetic force generated by the current flowing through the third conductor part still acts on a part of the movable contact arm continuously, even in the open extreme state, while reducing the electromagnetic force for extending the arc toward the terminal section.

By providing lengthwise slots or recesses along the first and third conductor parts so that they connects continuously beyond the member's common boundary to permit unobstructed passage of said movable contact arm therethrough at the time of the arm's rotation, the switch has another advantage of being built relatively easily.

BRIEF DESCRIPTION OF THE DRAWINGS

While the novel features of the present invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENTS

In the following paragraphs, the present invention will be described in more detail referring to the preferred embodiments shown in the attached drawings. Although the description will be limited exclusively to the case of an electric circuit breaker for clarity of the illustration, the present invention can be embodied in switches other than the circuit breaker and similar advantages will be available.

EXAMPLE 1

Figure 1:
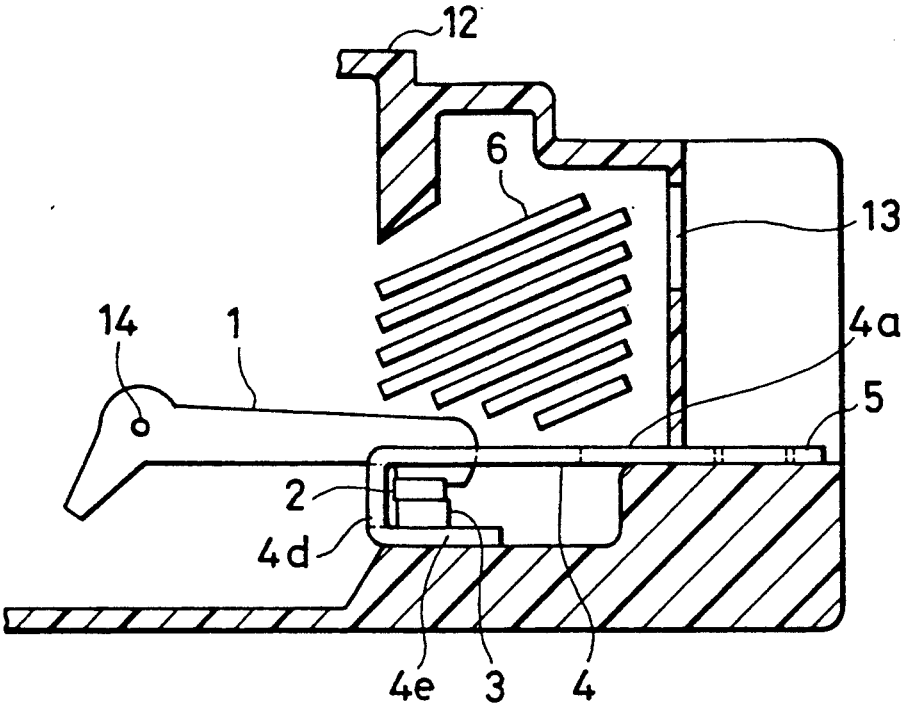
FIG. 1 is a schematic side view of the circuit breaker built in accordance with an embodiment of the present invention in its closed circuit position.

FIG. 1 is a schematic side view showing a switch representing an embodiment built in accordance with the present invention. As shown in this figure, a movable contact arm 1 is fulcrumed at the proximal end (fulcrumed end), which is opposite the distal end, by a pin 14 to a frame (not shown), and a moving contact 2 is fixed on a distal end (moving end) of the movable contact arm 1. A fixed contact 3 is touched by said moving contact 2. A stationary conductor 4 carries the fixed contact 3. The stationary conductor 4 is composed of a laterally disposed u-shape-folded strip of an elongated conductor including a long upper horizontal conductor part 4*a*, vertical conductor part 4*d* and a folded-back short conductor plate part 4*e*.

As more clearly illustrated by reference to FIG. 3, a lengthwise slot 41 is provided along the oblong stationary conductor 4 and consists of fragmentary slots 41*a* and 41*d*, which are connected continuously beyond the boundary between the conductor parts 4*a* and 41*d*. The slot 41 is configured with a sufficient width for accommodating the movable contact arm 1 to permit its unobstructed passage at the time of rotating the arm 1 to allow the moving contact 2 to reach the fixed contact 3. The conductor part 4*a* has a terminal section 5 at its proximal end, which is situated over the contacting face of the fixed contact 3 in this closed circuit position. The folded-back conductor part 4*e*, which carries the fixed contact 3 thereon, is connected through the vertical conductor part 4*d*, to the upper horizontal conductor part 4*a* which has the terminal section 5 at its proximal end. The whole length of the upper horizontal conductor part 4*a* is situated over the contacting face of the fixed contact 3. The vertical conductor part 4*d* is disposed between the fulcrum pin 14 as an axis of rotation of the movable contact arm 1 and the fixed contact 3. Each arc extinguish plate (arc chute) 6 has a slot for permitting the unobstructed rotation of the movable contact arm 1. A switch housing has an exhaust outlet 13.

Figure 2:
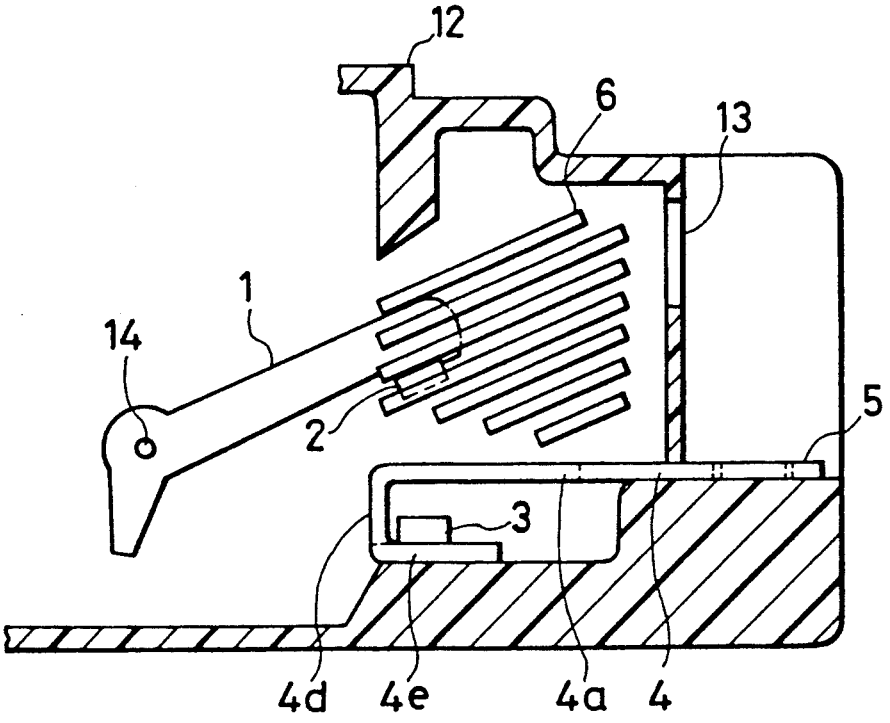
FIG. 2 is a schematic side view of the circuit breaker shown in FIG. 1 in its open circuit position.

In the state shown in FIG. 2, the movable contact arm 1 is in its open-circuit position, wherein the upper horizontal a conductor part 4*a* connected to the terminal section 5 of the stationary conductor 4 is situated lower than the contacting face of the moving contact 2.

Figure 3:
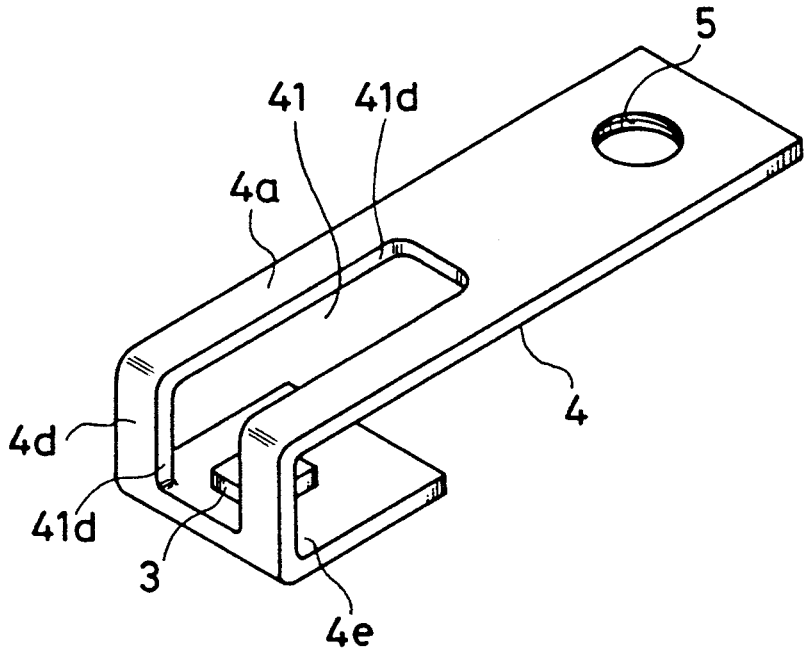
FIG. 3 is a perspective view of the stationary conductor used in the circuit breaker shown in FIGS. 1 and 2.

The perspective view of FIG. 3 schematically shows the stationary conductor 4 having the terminal section 5. The stationary conductor 4 of this embodiment is configured in the laterally laid u-shape, and is provided with a lengthwise slot 41 composed of fragmentary slots 41*a* and 41*d* which are connected continuously beyond the boundary between the conductor parts 4*a* and 4*d*. In FIGS. 1 and 2, the mechanical unit 8 and the like are omitted from the illustration for brevity because they are configured substantially the same as those of the known conventional circuit breakers.

In the following paragraphs, the operation of the shown circuit breaker will be described. When a large current of a very high level, such as short-circuiting current, flows through the circuit breaker in its closed circuit position, the movable contact arm 1 rotates prior to the actuation of the mechanical unit 8, thereby causing the contacts 2 and 3 to separate from each other hence generating an arc across the contacts 2 and 3, in the same manner as described on the conventional circuit breakers.

Figure 4:
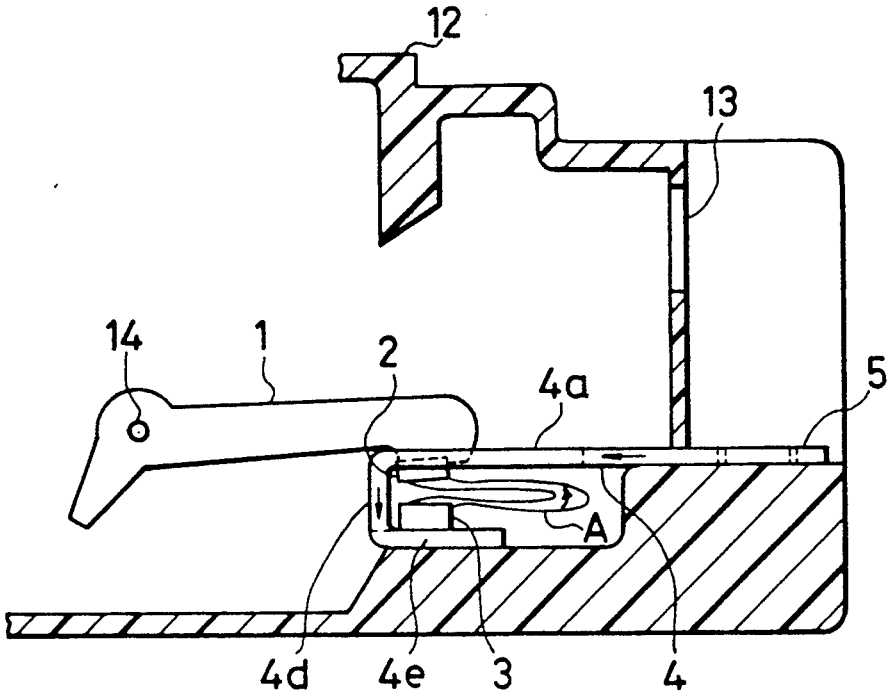
FIG. 4 is a schematic side view of the circuit breaker shown in FIGS. 1 through 3 illustrating a state immediately after the breaking of both the contacts which had just been in its closed circuit position.

FIG. 4 is a schematic view of the exemplified circuit breaker in a state immediately after the opening of the contacts 2 and 3, showing their relative positions, wherein the contacting face of the moving contact 2 is still at a position lower than the upper horizontal conductor part 4*a* of the stationary conductor 4, which is connected to the terminal section 5. In this figure, arrows indicate the directions of the current and the arc extinguishing plates are omitted for the clarity of illustration. The path for the current flowing from the terminal section 5 to the boundary of the conductor parts 4*a* and 4*d* above the arc A. As a result, an electromagnetic force, which is generated by the current flowing through the limited path and acting on the arc A is a force for extending the arc A toward the terminal section 5. Since the current flowing through the vertical conductor part 4*d* is in a direction opposite to the current of the arc A, an electromagnetic force created by the current which serves extend the arc A toward the terminal section 5. Therefore, all of the electromagnetic forces generated by the current flowing through the stationary conductor 4 become a force for extending the arc A toward the terminal section 5. As a result, the arc A which is generated immediately after the opening of the contacts is extending forcefully and its arc resistance is made great, thereby giving the circuit breaker an excellent current limiting characteristics.

Figure 5:
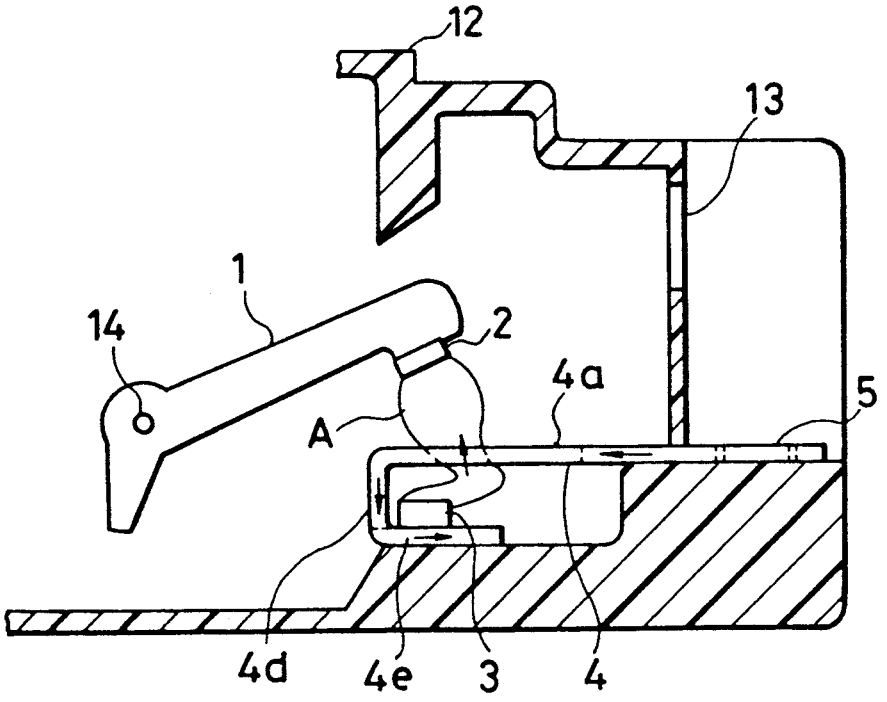
FIG. 5 is a schematic side view of the circuit breaker shown in FIGS. 1 through 4 illustrating a process of opening both the contacts by rotating a movable contact arm.

Next, a state of the circuit breaker wherein the movable contact arm 1 rotates to its extreme is shown in the schematic view of FIG. 5. At this state of FIG. 5, the current is increased as compared with the above-mentioned state immediately after the breaking of the contacts. In this state of FIG. 5, only an electromagnetic force generated by the current flowing through the conductor part 4*d* can effectively act on the arc A to extend it toward the terminal section 5. All other electromagnetic forces generated by the current flowing through the vertical and folded-back conductor parts 4*d* and 4*e* do not act to extend the arc A toward the terminal section 5. An electromagnetic force generated by the current flowing through the movable contact arm 1 acts as a force for extending the arc A toward the terminal section 5. However, it is substantially offset by the electromagnetic force generated by the current flowing through the conductor part 4*a*, because the current flowing through the conductor part is a force for extending the arc A in a direction opposite to the terminal section 5.

If the relative position and the length of the stationary conductor 4 are taken into account, the magnitude of the electromagnetic force, which is offset by the electromagnetic force generated by the current flowing through the movable contact arm 1, is greater than the magnitude of the electromagnetic force attributable to the current flowing through the vertical conductor part 4*d*. As a result, it is obvious that the electromagnetic force for extending the arc A, which is over the upper horizontal conductor part 4*a* toward the terminal section 5, is reduced. As a result, the amount of the hot gas expelled from the exhaust outlet 13 is also reduced. Furthermore, since the degree of extension of the arc A at this region becomes moderate and the amount of the generated arc energy becomes small, the damage in the circuit breaker is drastically reduced. Moreover, the structure of the stationary conductor 4 shown in the perspective view of FIG. 3 is also advantageous in enabling one to build it relatively easily.

EXAMPLE 2

Figure 6:
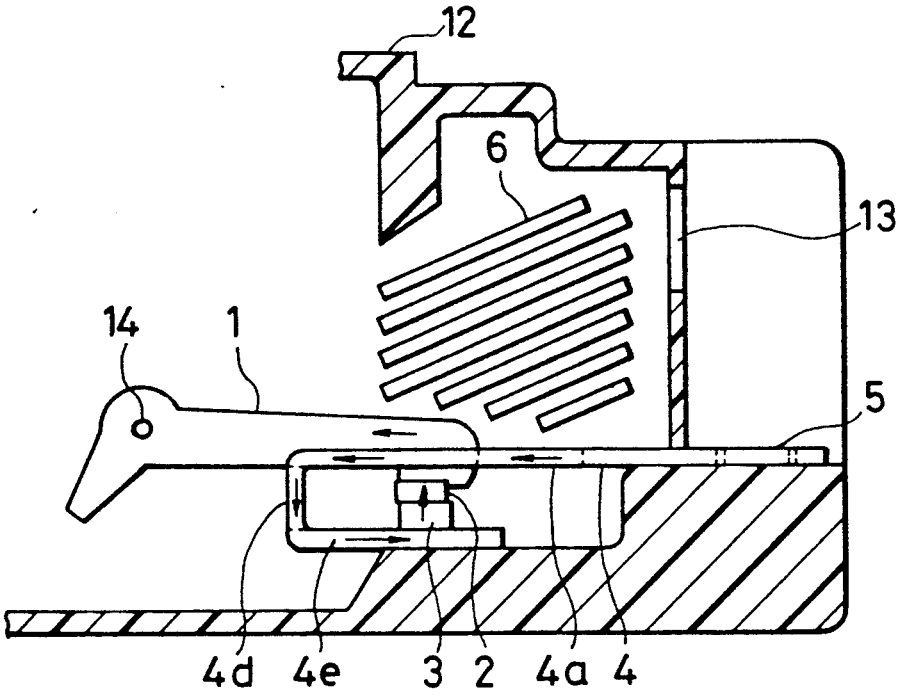
FIG. 6 is a schematic side view of the circuit breaker built in accordance with another embodiment of the present invention in its closed circuit position.

FIG. 6 shows a second example. In this embodiment, the folded-back part 4*e* of the stationary conductor 4 is extended in the direction toward the fulcrum pin 14 the movable contact arm 1 beyond the position of the fixed contact 3, as shown in FIG. 6. Therefore, the direction of the current flowing through the conductor part 4*e* is substantially in parallel with and in the direction opposite to that of the current flowing through the movable contact arm 1 in its closed circuit position. By the above-mentioned configuration, an electromagnetic force generated by the current flowing through the folded-back conductor part 4*e* extends the arc A toward the terminal section 5. In addition, an electromagnetic repulsive force acts between the movable contact arm 1 in its closed circuit position and the folded-back conductor part 4*e* of the stationary conductor 4. As a result, the rotational speed of the movable contact arm 1 is increased, and the arc immediately after the breaking of the contact is rapidly elongated. Thus, the rise-up of the arc resistance are rapid, and the current limiting characteristics of the circuit breaker are further improved.

EXAMPLE 3

Figure 7:
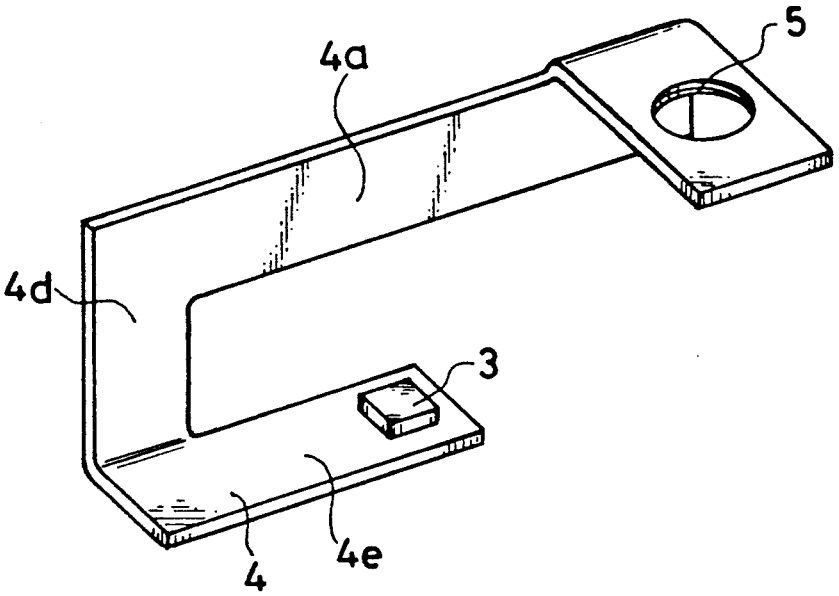
FIG. 7 is a schematic perspective view of another stationary conductor used in the circuit breaker shown in FIGS. 1 and 2.
Figure 8:
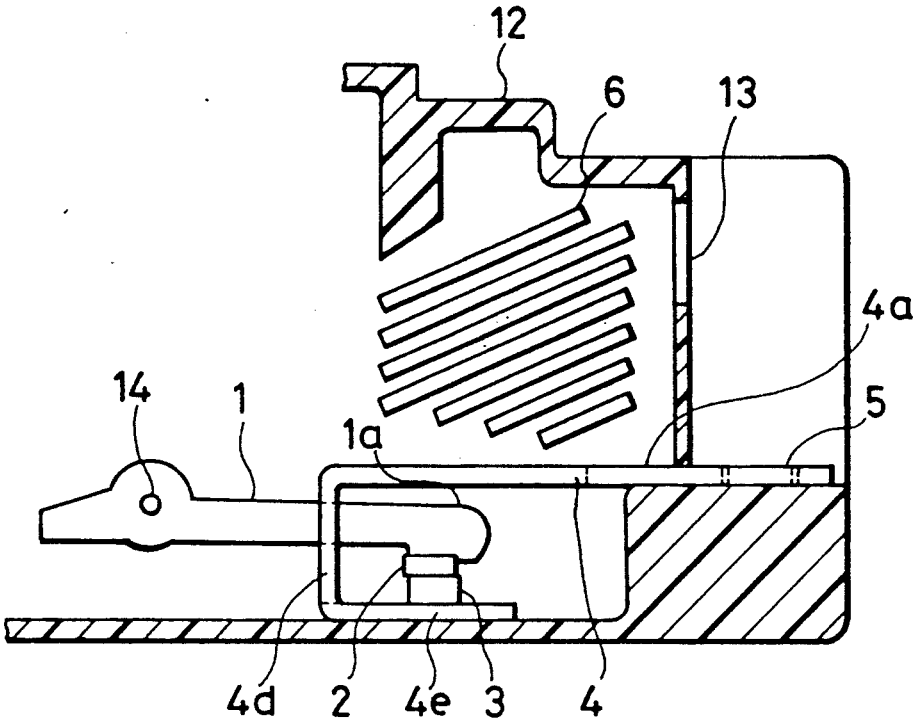
FIG. 8 is a schematic side view of the circuit breaker built in accordance with a further embodiment of the present invention in its closed circuit position.
Figure 9:
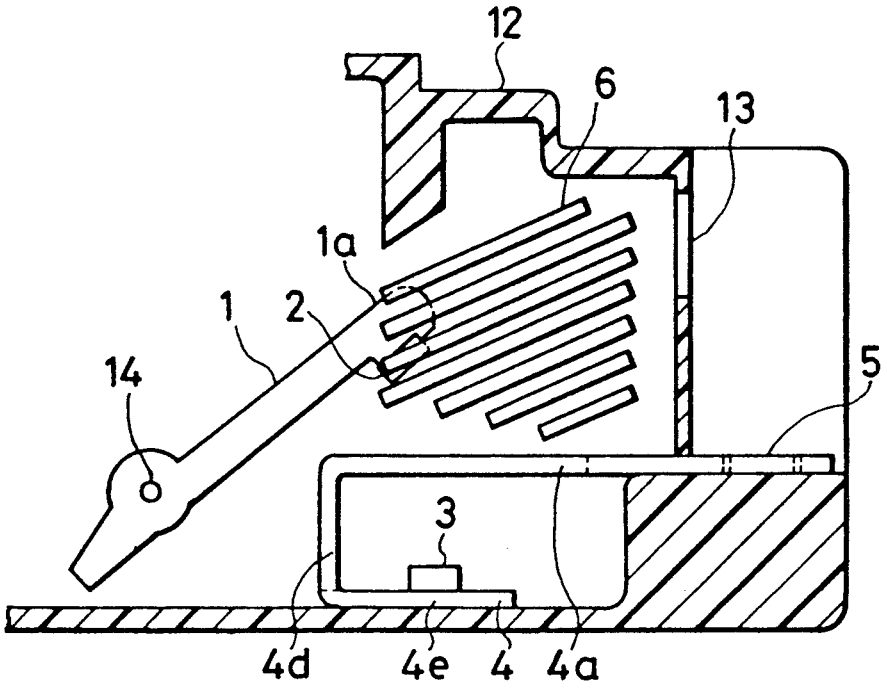
FIG. 9 is a schematic side view of the circuit breaker built shown in FIG. 8 in its open circuit position.

FIG. 7 shows a further modified example. In this embodiment, the stationary conductor 4 is configured as shown in FIG. 7. Instead of providing a lengthwise slot 41 composed of fragmentary slots 41*a* and 41*d*, which are connected continuously beyond the boundary between the upper-horizontal and vertical conductor parts 4*a* and 4*d* as shown in FIG. 3, the upper-horizontal and vertical conductor parts 4*a* and 4*d* are formed integrally in an inverted L-shaped vertical metal plate, which is integrally connected to the horizontal terminal section 5 and also to the horizontally shaped folded-back part 4*e*. By arranging in the same profile positional relationships of skeleton configuration among the conductor parts 4*a*, 4*d* and 4*e*, the fixed contact 3, the terminal section 5, and the movable contact arm 1 as those of the foregoing embodiments, the same advantage as the foregoing embodiments can also be realized.

EXAMPLE 4

FIG. 8 through FIG. 12 show a schematic view showing a further embodiment of the switch built in accordance with the present invention. The same reference numerals and symbols as used in the description of the foregoing embodiments are also used in this figure for designating the components and the directions of the currents. The description made in the foregoing embodiments are also applicable to this embodiment. In this embodiment, the axis of the fulcrum pin 14 of the movable contact arm is provided in a level which is lower than the conductor part 4*a* of the stationary conductor 4, as opposed to the previous embodiments, wherein the fulcrum pin 14 is in a level higher than the conductor part 4*a*. In other words, a plane including the axis of the fulcrum pin 14 and in parallel with a plane defined by the conductor part 4*e* is between the plane defined by said conductor part 4*a* and the plane defined by the conductor part 4*e*, as shown in FIGS. 8 through 12.

In the following paragraphs, the operation of the shown circuit breaker will be described. When a current of a very high level such as short-circuiting current flows through the circuit breaker in its closed circuit position, the movable contact arm 1 rotates prior to the actuation of the mechanical unit 8, in the same manner as described with the conventional circuit breakers, and thereby the contacts 2 and 3 are driven to separate from each other and to generate an arc across the contacts 2 and 3.

Figure 11:
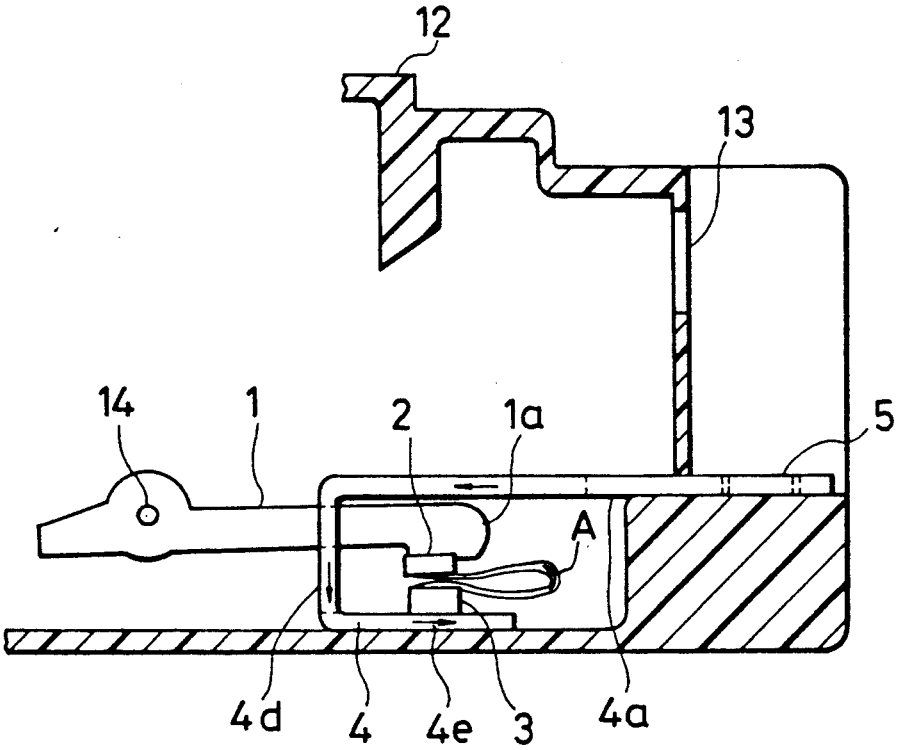
FIG. 11 is a schematic side view of the circuit breaker shown in FIGS. 8 through 10 illustrating a state immediately after the breaking of both the contacts which had just been in its closed circuit position.

FIG. 11 is a schematic view of the exemplified circuit breaker in a state immediately after the breaking of the contacts 2 and 3. FIG. 11 shows their relative positions that the contacting face of the movable contact member 1 is still lower than the upper horizontal conductor part 4*a* of the stationary conductor 4, which is connected to the terminal section 5. In this figure, arrows indicate the directions of the current and the arc extinguishing plates 6 are omitted for the clarity of illustration. The path for the current flowing from the terminal section 5 to the boundary of the conductor parts 4*a* and 4*d* is higher than the arc A. As a result, an electromagnetic force generated by the current flowing through the limited path and acting on the arc A acts as a force for extending the arc A toward the terminal section 5. Since the current flowing through the conductor part 4*d* is in a direction opposite to the current of the arc A, an electromagnetic force of the current is a force for extending the arc A toward the terminal section 5. Therefore, all of the electromagnetic force generated by the current flowing through the stationary conductor 4 will be a force for extending the arc A toward the terminal section 5. As a result, the arc A generated immediately after the opening of the contacts is extended forcefully.

Further, out of all the electromagnetic force generated by the current flowing through the path composed of the stationary conductor 4, only an electromagnetic force attributable to the current flowing through the conductor part 4*d* can effectively act on the movable contact arm to reduce its rotational speed. The electromagnetic force generated by the current flowing through the vertical conductor part 4*d* can act on the part of the movable contact arm 1, which is between the conductor part 4*d* and the fulcrum pin 14. All of the current flowing through the upper horizontal and folded-back conductor parts 4*a* and 4*e* of the stationary conductor 4 can generate an electromagnetic force, which is in a direction of increasing the rotational speed of the movable contact arm 1. In addition, the current flowing through the vertical conductor part 4*d* can also generate an electromagnetic force which acts on the movable contact arm 1 between the vertical conductor part 4*d* and the moving contact 2. That determines the rotational speed of the movable contact arm 1, is not the force which acts on the movable contact arm 1 but is a torque generated around the fulcrum pin 14. The torque is a product of the force and the distance between a point at which the force acts and the fulcrum pin 14. Therefore, it is apparent that a compound torque obtained by combining the respective electromagnetic forces which are attributable to the currents flowing through the respective conductor parts of the stationary conductor 4, which effectively act on the respective parts of the movable contact arm 1, is such a torque that the constituents for increasing the rotational speed of the movable contact arm 1 is predominant. As a result, the rotational speed of the movable contact arm 1 immediately after the breaking of the contacts is made great, and thus, the arc A is forcefully extended and its arc resistance is made great to give the circuit breaker an excellent current limiting characteristic.

Figure 10:
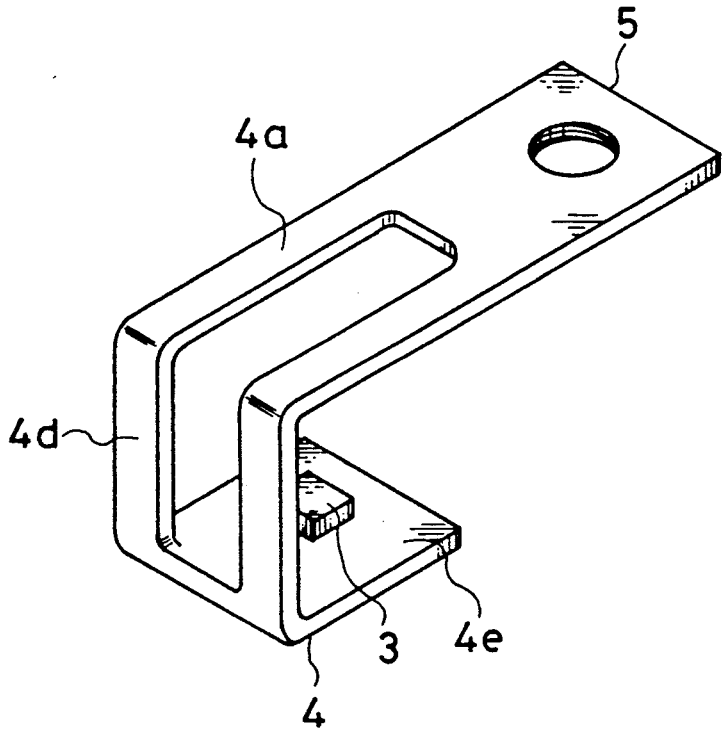
FIG. 10 is a schematic perspective view of the stationary conductor used in the circuit breaker shown in FIGS. 8 and 9.
Figure 12:
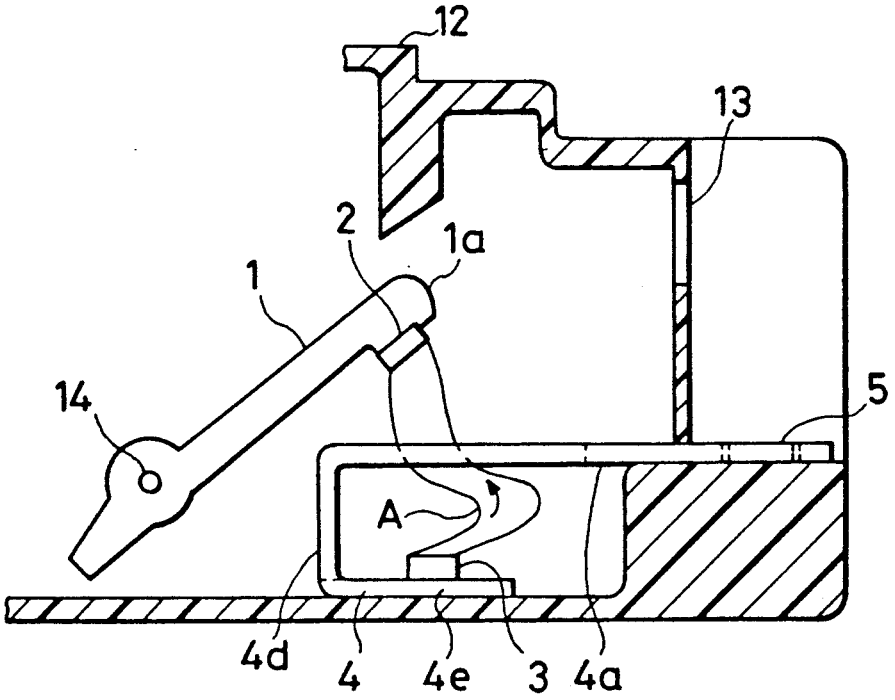
FIG. 12 is a schematic side view of the circuit breaker shown in FIGS. 8 through 11 illustrating a process of opening both the contacts by rotating a movable contact arm.

Next, a state of the circuit breaker wherein the movable contact arm 1 rotates to its open extreme is shown in the schematic view of FIG. 12. At this time, the current is increased as compared with the state immediately after the breaking of the contacts. In this state, out of all the electromagnetic forces which are generated by the current flowing through the current path from the terminal section 5 to the upper horizontal conductor part 4*a* and acting on the arc A, which is situated above the current path, only the electromagnetic forces attributable to the currents flowing through the upper horizontal and the folded-back conductor parts 4*d* and 4*e* can actually extend the arc A toward the terminal section 5. An electromagnetic force generated by the current flowing through the movable contact arm 1 is a force for extending the arc A toward the terminal section 5. However this electromagnetic force is substantially offset by the electromagnetic force attributable to the current flowing through the upper horizontal conductor part 4*a*. This is because the latter results force extends the arc A in a direction opposite to the terminal section 5. If the relative positions and the lengths of the vertical and the folded-back conductor parts 4*d* and 4*e* of the stationary conductor 4 are taken into account, the magnitude of the electromagnetic force being offset by what is generated by the current flowing through the movable contact arm 1 is greater than the magnitude of the additional electromagnetic force generated by the current flowing through the conductor parts 4*d* and 4*e*. As a result, the electromagnetic force for extending the arc A which is situated above the upper horizontal conductor part 4*a* toward the terminal section 5 is reduced. Consequently, the amount of the hot gas expelled from exhaust outlet 13 is also reduced. Furthermore, since the degree of extension of the arc A at this region is moderate and the amount of the generated arc energy is small, the damage in the circuit breaker is drastically reduced. Moreover, the structure of the stationary conductor 4 shown in the perspective view of FIG. 10 is also advantageous in its easiness of building.

EXAMPLE 5

Figure 13:
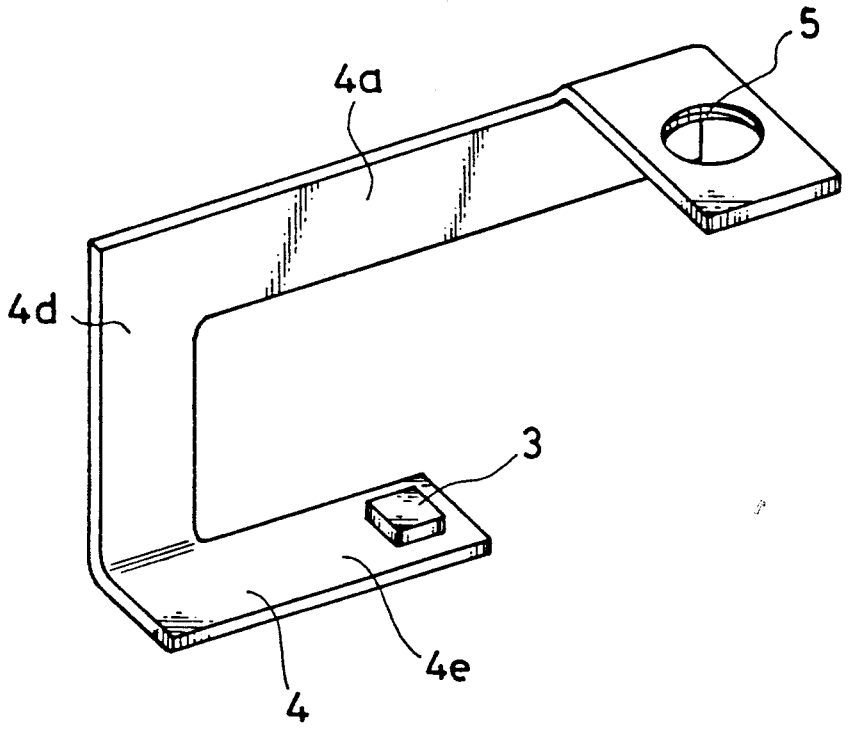
FIG. 13 is a schematic perspective view of another stationary conductor used in the circuit breaker shown in FIGS. 8 and 9.

In this embodiment, the stationary conductor 4 is configured as shown in FIG. 13. Instead of providing a lengthwise slot 41 composed of fragmentary slots 41*a* and 41*d* connected continuously beyond the boundary between the conductor parts 4*a* and 4*d* shown in FIG. 10, the upper horizontal and the vertical conductor parts 4*a* and 4*d* are formed integrally in a vertical plate which connects the horizontal terminal section 5 with the folded-back conductor part 4*e*. Provided that the same positional relationships among the conductor parts 4*a*, 4*d* and 4*e*, the fixed contact 3, the terminal section 5, and the movable contact arm 1 as those of the foregoing embodiment are maintained in this embodiment, the same advantages can also be realized.

EXAMPLE 6

Figure 14:
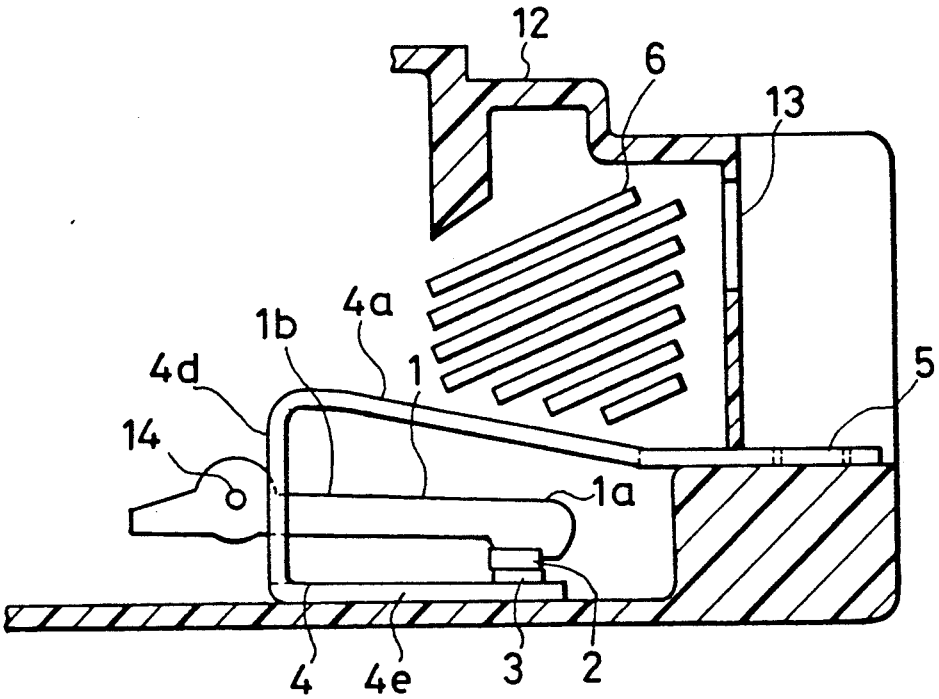
FIG. 14 is a schematic side view of the circuit breaker built in accordance with still another embodiment of the present invention in its closed circuit position.
Figure 15:
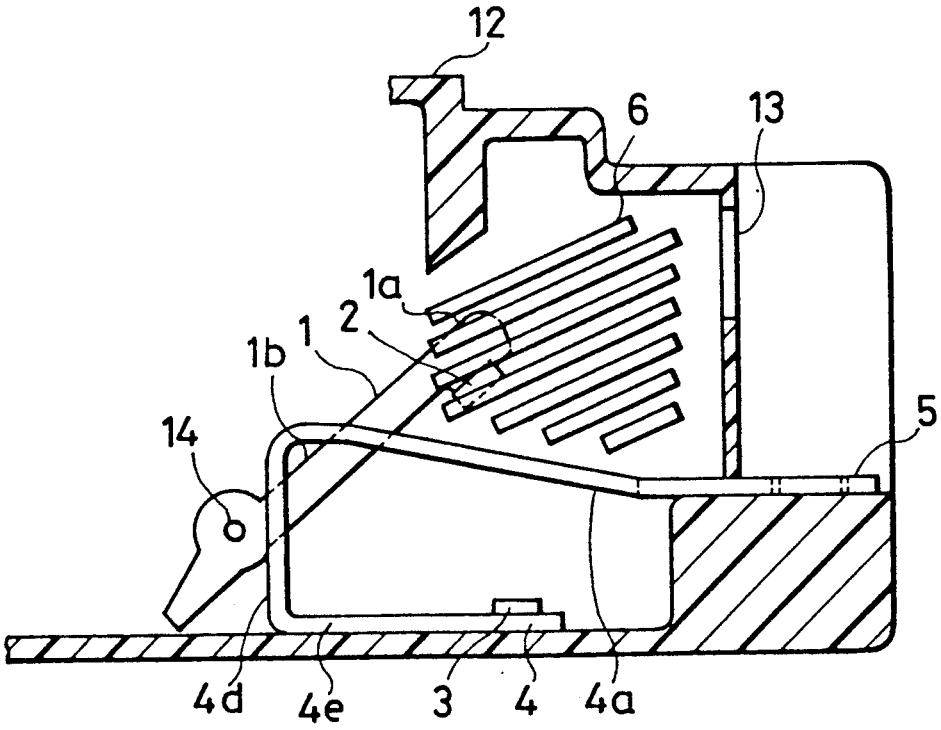
FIG. 15 is a schematic side view of the circuit breaker shown in FIG. 14 in its open circuit position.

FIG. 14 is a schematic view showing still another embodiment of the switch built in accordance with the present invention. The same reference numerals and symbols as used in the description of the foregoing embodiments are also applicable in this figure for designating the components and the directions of the currents. In this embodiment, the fulcrum pin 14 of rotation of the movable contact arm 1 is also provided in a level lower than the upper horizontal conductor part 4*a* of the stationary conductor 4 including the terminal section 5, as opposed to the previous embodiments of Examples 1–3, wherein the fulcrum pin is in a level higher than the upper horizontal conductor part 4*a*. In other words, a plane including the fulcrum pin 14 and in parallel with a plane defined by the conductor part 4*e* is between the upper plane defined by the terminal section 5 of said upper horizontal conductor part 4*a* and the lower plane defined by the folded-back conductor part 4*e*, like the previous embodiment shown in Examples 4 and 5. In addition, the upper horizontal conductor part 4*a* is not in the same plane as the terminal section 5, but is partly lifted upward to the boundary between the conductor part 4*a* and the conductor part 4*d*, as shown in FIGS. 14 through 18. In other words, said plane including the fulcrum pin 14 interects the plane defined by said conductor part 4*a*. Further, a part 1*b* of the movable contact arm 1 is situated below the upper horizontal conductor part 4*a* in the open-circuit state of the circuit breaker as illustrated by FIGS. 15 and 18.

In the following paragraphs, the operation of the shown circuit breaker will be described. When a current of a very high level, such as short-circuiting current, flows through the circuit breaker in its closed circuit position, the movable contact arm 1 rotates prior the actuation of the mechanical unit 8, thereby to causing the contacts 2 and 3 to separate from each other and to generate an arc A across the contacts 2 and 3, similarly to the conventional circuit breakers.

Figure 17:
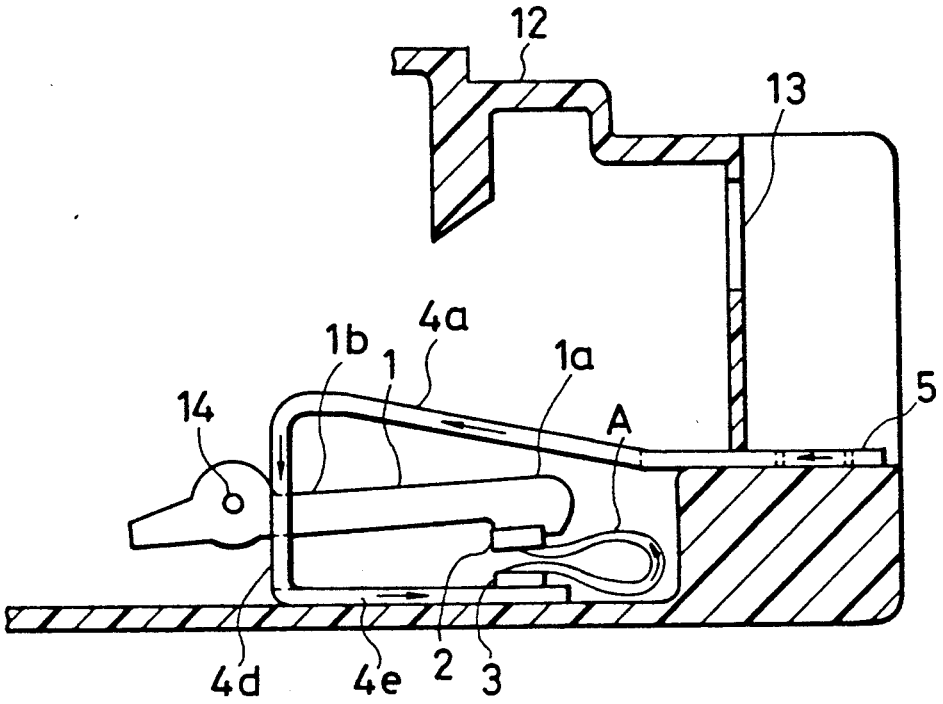
FIG. 17 is a schematic side view of the circuit breaker shown in FIGS. 14 through 16 illustrating a state immediately after the breaking of both the contacts which had just been in its closed circuit position.
Figure 18:
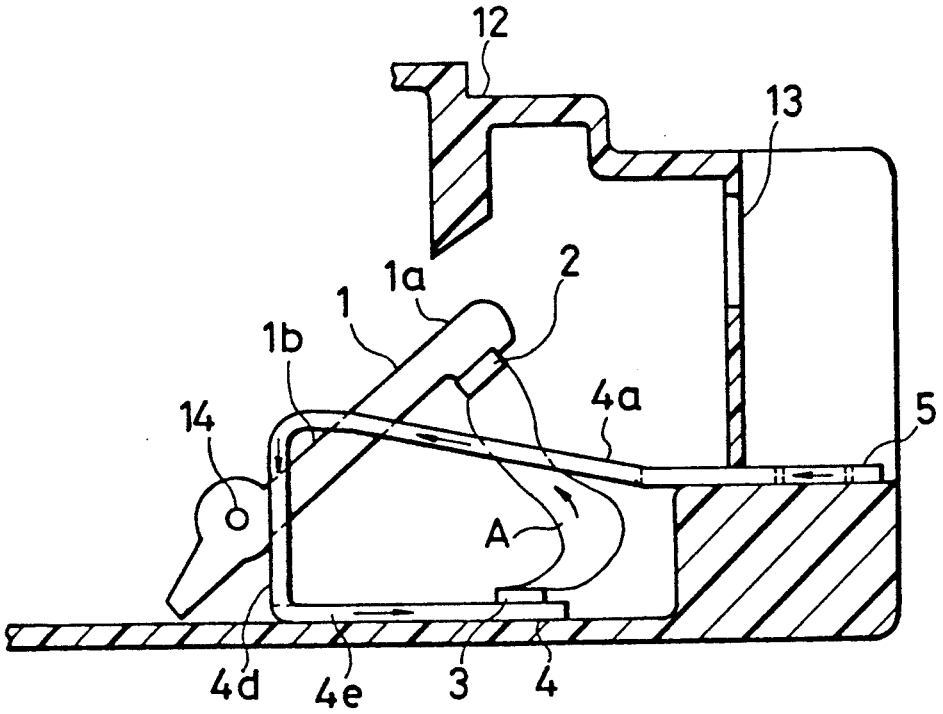
FIG. 18 is a schematic side view of the circuit breaker shown in FIGS. 14 through 16 illustrating a process of opening both the contacts by rotating a movable contact arm.

FIG. 17 is a schematic view of the exemplified circuit breaker in a state immediately after the breaking of the contacts 2 and 3, showing their relative positions wherein the contacting face of the movable contact member 1 is still lower than the upper horizontal conductor part 4a of the stationary conductor 4 connected to the terminal section 5. In this figure, arrows indicate the directions of the current and the arc extinguishing plates 6 are omitted for the clarity of illustration. All the path for the current flowing from the terminal section 5 to the boundary of the upper horizontal and the vertical conductor parts 4a and 4d is in the level upper than that of the arc A. As the result, all the electromagnetic forces which are generated by the current flowing through the limited path and acting on the arc A is a force for extending the arc A toward the terminal section 5. Since the current flowing through the vertical conductor part 4d is in the opposite direction to the current of the arc A, the electromagnetic force of the latter current is a force to extend the arc A toward the terminal section 5. In addition, the electromagnetic force attributable to the current flowing through the folded-back conductor part 4e will also be a force to extend the arc A toward the terminal section 5. Therefore, all the electromagnetic forces generated by the current flowing through the stationary conductor 4 are forces for extending the arc A toward the terminal section 5. As a result of these, the arc A generated immediately after the breaking of the contacts is extended forcefully to make its arc resistance high.

The resultant high arc resistance means a high voltage between the contacts 2 and 3. Therefore, unless there is an insulating distance between the contacts 2 and 3 sufficient for withstanding the high voltage, a dielectric breakdown might occur between the contacts. Thus, unless the rotational speed of the movable contact arm 1 is sufficiently large, no current limiting is possible.

In the state immediately after the breaking of the contacts as shown in FIG. 17, out of all the electromagnetic forces generated by the current flowing through the stationary conductor 4, only an electromagnetic force attributable to the current flowing through the vertical conductor part 4d can effectively act on the movable contact arm to reduce its rotational speed. However, the electromagnetic force generated by the current flowing through the vertical conductor part 4d can act on only the section of the movable contact arm 1 which is between the vertical conductor part 4d and the fulcrum pin 14. All of other currents flowing through other conductor parts of the stationary conductor 4 can generate an electromagnetic force in a direction of increasing the rotational speed of the movable contact arm 1. In addition, the current flowing through the vertical conductor part 4d itself can also generate an electromagnetic force which acts on the movable contact arm 1 between the vertical conductor part 4d and the moving contact 2, thereby increasing the rotational speed of the movable contact arm 1. Therefore, the rotational speed of the movable contact arm 1 immediately after the breaking of the contacts is increased.

Further, even in the state wherein the movable contact arm 1 rotates to its open extreme as shown in FIG. 18, the electromagnetic force for rotating the movable contact arm still continues to act on the part 1b of the movable contact arm 1. Therefore, in this embodiment, the time period from the instant immediately after the breaking of the contacts to the instant when the movable contact arm 1 reaches its open extreme is shortened. As a result, even a high voltage is applied across the contacts, no dielectric breakdown occurs and the circuit breaker of this embodiment demonstrates an excellent current limiting performance.

Figure 16:
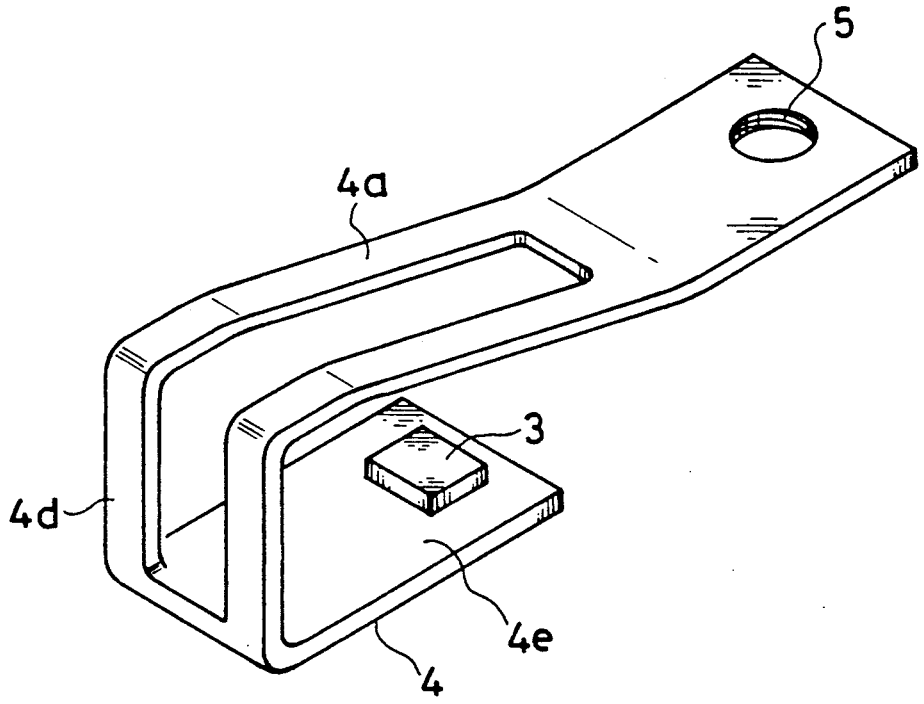
FIG. 16 is a schematic perspective view of the stationary conductor used in the circuit breaker shown in FIGS. 14 and 15.

In FIG. 18 showing a state wherein the movable contact arm 1 rotates to its extreme, the current is increased as compared with the state immediately after the breaking of the contacts. In this state, out of all the electromagnetic forces which are generated by the current flowing through the current path from the terminal section 5 to the upper horizontal conductor part 4a and acting on the arc A which is situated above the current path, only the electromagnetic force attributable to the currents flowing through the conductor parts 4d and 4e can actually extend the arc A toward the terminal section 5. An electromagnetic force generated by the current flowing through the movable contact arm 1 produce a force for extending the arc A toward the terminal section 5. Since the electromagnetic force attributable to the current flowing through the upper horizontal conductor part 4a is a force for extending the arc A in a direction opposite to the terminal section 5, the electromagnetic forces generated by the currents flowing through the movable contact arm 1 and the folded-back conductor part 4e substantially offset each other. If the relative position and the length of the vertical conductor part 4d of the stationary conductor 4 are taken into account, the magnitude of the electromagnetic force attributable to the movable contact arm 1, which is offset by that generated by the current flowing through the folded-back conductor part 4e, is greater than the magnitude of the additional electromagnetic force generated by the current flowing through the vertical conductor part 4d. As a result, the electromagnetic force for extending the arc A which is above the upper horizontal conductor part 4a toward the terminal section 5 is reduced. As a result, the amount of the hot gas expelled from the exhaust outlet 13 is also reduced. Furthermore, since the degree of extension of the arc A at this region is moderate and the amount of the generated arc energy is small, the damage in the circuit breaker is drastically reduced. Moreover, the structure of the stationary conductor 4 shown in the perspective view of FIG. 16 is also advantageous in enabling manufacturing of the conductor relatively easily.

EXAMPLE 7

Figure 19:
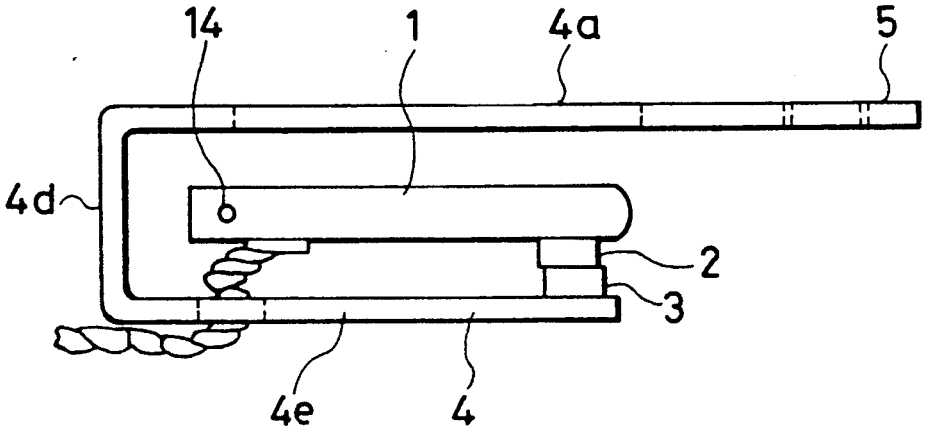
FIGS. 19 and 20, each is a schematic side view of another arrangement with respect to the relative positions of the stationary conductor and the movable contact arm used in the circuit breaker shown in FIGS. 14 through 16.
Figure 20:
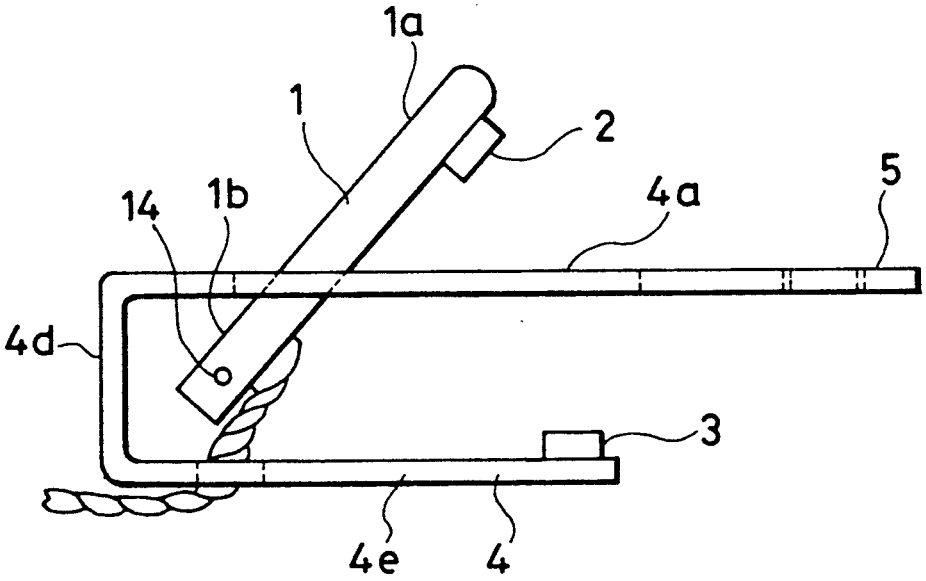
Figure 21:
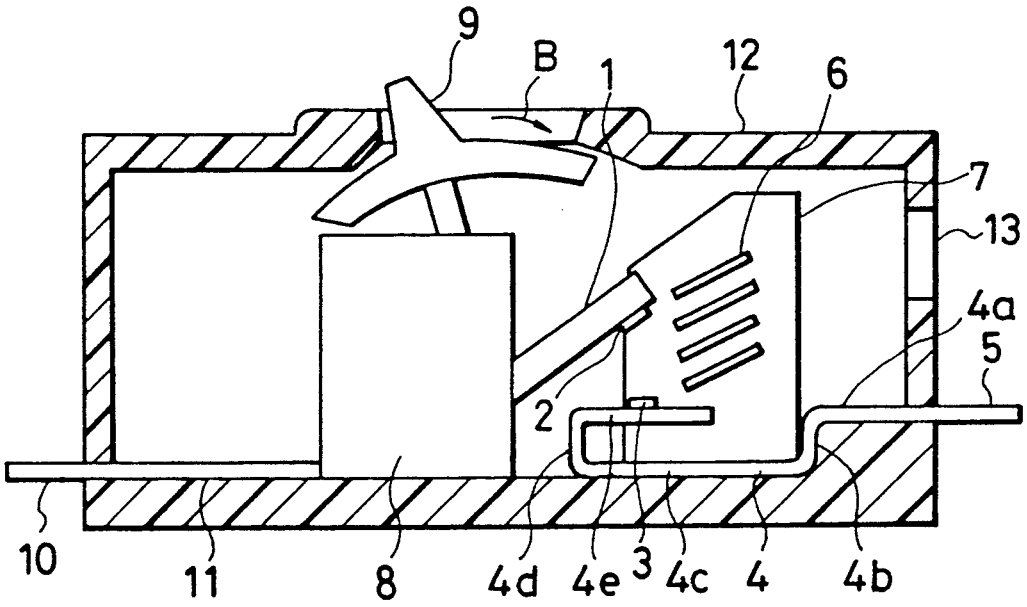
FIG. 21 (Prior Art)
FIG. 21 is a schematic side cross-sectional view of an example of the conventional circuit breaker.
Figure 22:
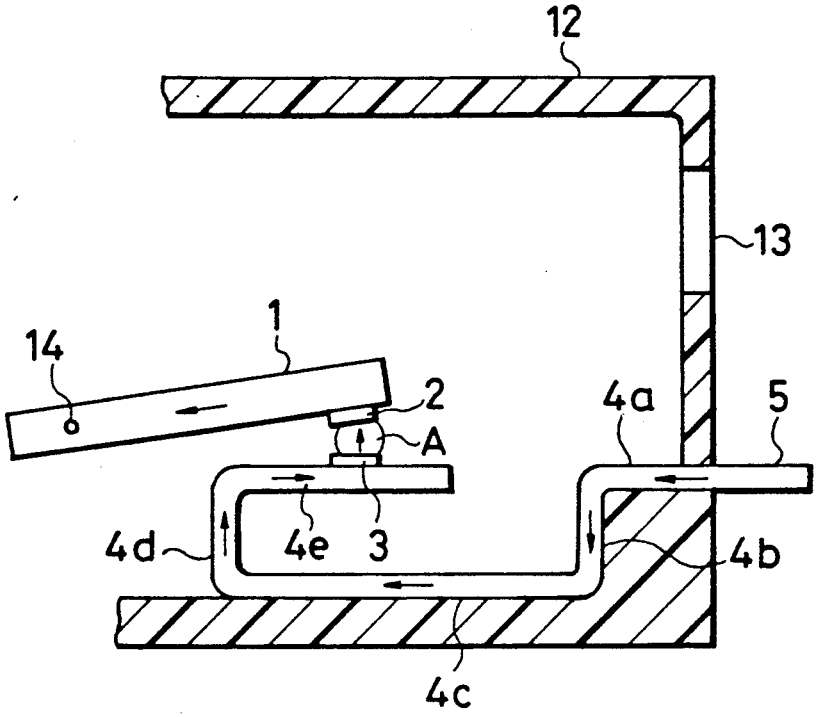
FIG. 22 (Prior Art)
FIG. 22 is the schematic side view of the essential part of the conventional circuit breaker shown in FIG. 21 indicating a state immediately after the breaking of both the contacts which had just been in its closed circuit position.
Figure 23:
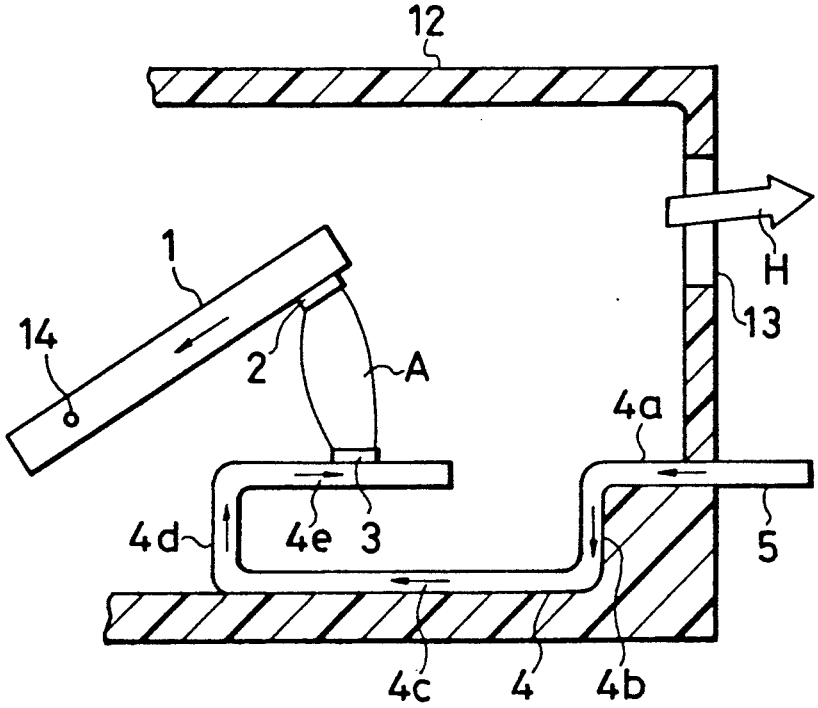
FIG. 23 (Prior Art)
FIG. 23 is the schematic side view of the essential part of the conventional circuit breaker shown in FIGS. 21 and 22 indicating a process of opening both the contacts by rotating a movable contact arm.

In this embodiment, the relative positions of the stationary conductor 4 with respect to the movable contact arm 1 are arranged as shown in schematic side views of FIGS. 19 and 20. FIG. 19 shows the relative positions of these components in the closed-circuit state of the circuit breaker whereas FIG. 20 shows their open-circuit state. As shown by those figures, instead of providing the fulcrum pin 14 of the movable contact arm 1 outside the space defined by the stationary conductor 4 as described with respect to the foregoing embodiments, the entire movable contact arm 1 including its fulcrum pin 14 is accommodated in a space defined by stationary conductor 4, in the closed circuit state.

Even in the open-circuit state, wherein the movable contact arm rotates to its open extreme, the near-fulcrum part 1b of the movable contact arm 1 is still in the space and is subjected to the continued influence by the electromagnetic force generated by the current flowing through the conductor parts 4a and 4d. Being configured as described above, the switch of this embodiment also has an advantage similar to that obtained by the previous embodiments shown in FIGS. 14 through 18.

Although the present invention has been described in its preferred form with a certain degree of particularity, it is understood that the present disclosure of the preferred form can be changed in the details of construction and the combination and arrangement of parts and components may be resorted to without deviating from the spirit and the scope of the invention as hereinafter claimed.

What is claimed is:

1. An electrical switch comprising: a movable contact arm with an elongate conductor having
- a moving contact on a distal end, and
- a fulcrum pin on a proximal end, pivotally supported by a housing; and a stationary elongate conductor having,
- a first conductor part including a horizontal portion and having a terminal on a first end,
- a vertical conductor part having a first end connected to a second end of said first conductor part,
- a folded back conductor part parallel with said horizontal portion of said first conductor part and connected to a second end of said vertical conductor part, said folded back conductor part having a fixed contact thereon, and a substantially L-shaped slot extending from a central portion of said first conductor part through a central portion of said vertical conductor part, said slot being sized so that a portion of said movable contact arm may pass through said vertical conductor part and said first conductor part in order to enter and leave a closed circuit position wherein said moving contact is in contact with said fixed contact.

2. The switch of claim 1 wherein said vertical conductor part intersects a line between said fixed contact and an axis of said movable contact arm.

3. The switch of claim 1 wherein said first conductor part intersects a plane parallel to said fixed contact located between said moving contact and said fixed contact in an open circuit position, and said moving contact intersects a plane parallel to said fixed contact located between said fixed contact and said first conductor part in said closed circuit position.

4. The switch of claim 1 wherein said horizontal portion of said first conductor part includes a first horizontal portion and a second horizontal portion in parallel and connected by another portion, said terminal being on said second horizontal portion and said first horizontal portion being connected to said first end of said vertical conductor.

5. The switch of claim 1 wherein said vertical conductor part intersects a plane located between an axis of said fulcrum pin of said movable contact arm and said fixed contact.

6. An electrical switch comprising:

a movable contact arm with an elongate conductor having
- a moving contact on a distal end, and
- a fulcrum pin on a proximal end, pivotally supported by a housing; and a stationary elongate conductor having,
- a first conductor part including a horizontal portion and having a terminal on a first end,
- a vertical conductor part having a first end connected to a second end of said first conductor part,
- a folded back conductor part parallel with said horizontal portion of said first conductor part and connected to a second end of said vertical conductor part, said folded back conductor part having a fixed contact thereon, and
- a slot extending through a central portion of said first conductor part, said slot being sized so that a portion of said movable contact arm may pass through said first conductor part in order to enter and leave a closed circuit position wherein said moving contact is in contact with said fixed contact.

7. The switch of claim 6 wherein said first conductor part intersects a plane parallel to said fixed contact located between said moving contact and said fixed contact in an open circuit position, and said moving contact intersects a plane parallel to said fixed contact located between said fixed contact and said first conductor part in said closed circuit position.

8. The switch of claim 6 wherein said fulcrum pin of said movable contact arm is placed between said vertical conductor part and a plane parallel to said vertical conductor part intersecting said fixed contact.

* * * * *